US006837305B2

(12) United States Patent
Zurawel et al.

(10) Patent No.: US 6,837,305 B2
(45) Date of Patent: Jan. 4, 2005

(54) HEAT EXCHANGER PLATES AND MANUFACTURING METHOD

(75) Inventors: Peter Zurawel, Mississauga (CA); Brian Ernest Duke, Carlisle (CA); Raymond R. Caron, Burlington (CA)

(73) Assignee: Dana Canada Corporation, Oakville (CA)

( * ) Notice: Subject to any disclaimer, the term of this patent is extended or adjusted under 35 U.S.C. 154(b) by 0 days.

(21) Appl. No.: 10/452,183

(22) Filed: Jun. 2, 2003

(65) Prior Publication Data

US 2004/0226706 A1 Nov. 18, 2004

(30) Foreign Application Priority Data

Feb. 27, 2003 (CA) ..... 2420273

(51) Int. Cl.[7] ..... F28D 1/02

(52) U.S. Cl. ..... 165/153; 165/67; 165/166; 29/890.03

(58) Field of Search ..... 165/170, 153, 165/150, 151, 152, 78, 79, 67, 166, 167; 29/890.039

(56) References Cited

U.S. PATENT DOCUMENTS

| | | | | |
|---|---|---|---|---|
| 2,652,620 A | | 9/1953 | Sutowski | |
| 4,327,802 A | | 5/1982 | Beldam | |
| 4,401,154 A | | 8/1983 | Anders et al. | |
| 4,470,455 A | * | 9/1984 | Sacca | 165/167 |
| 4,497,196 A | | 2/1985 | Bakermans et al. | |
| 4,688,631 A | * | 8/1987 | Peze et al. | 165/166 |
| 5,150,520 A | | 9/1992 | DeRisi | |
| 5,176,205 A | * | 1/1993 | Anthony | 165/133 |
| 5,407,004 A | | 4/1995 | DeRisi et al. | |
| 5,538,077 A | * | 7/1996 | So et al. | 165/109.1 |
| 5,697,429 A | * | 12/1997 | Laveran et al. | 165/109.1 |
| 5,800,673 A | * | 9/1998 | Okuda et al. | 159/28.6 |
| 5,810,077 A | * | 9/1998 | Nakamura et al. | 165/153 |
| 5,896,916 A | * | 4/1999 | Baechner et al. | 165/78 |
| 5,918,664 A | | 7/1999 | Torigoe | |
| 6,122,814 A | | 9/2000 | Pennig et al. | |
| 6,145,587 A | * | 11/2000 | Hanafusa | 165/153 |
| 6,241,011 B1 | * | 6/2001 | Nakamura et al. | 165/153 |
| 6,256,856 B1 | | 7/2001 | Squillacci, Jr. et al. | |
| 6,273,183 B1 | | 8/2001 | So et al. | |
| 6,332,495 B1 | | 12/2001 | Jamison et al. | |
| 6,467,536 B1 | * | 10/2002 | Abate et al. | 165/153 |
| 2002/0000309 A1 | | 1/2002 | Kim et al. | |
| 2002/0124999 A1 | | 9/2002 | Chiba | |

FOREIGN PATENT DOCUMENTS

| | | |
|---|---|---|
| EP | 0 726 104 A | 8/1996 |
| FR | 2 058 396 A | 5/1971 |
| GB | 1 068 763 A | 5/1967 |

* cited by examiner

*Primary Examiner*—Terrell McKinnon
(74) *Attorney, Agent, or Firm*—Dykema Gossett PLLC

(57) ABSTRACT

A method for forming heat exchanger plates comprises formation of a fluid flow channel along the edges of a sheet metal strip or blank, and formation of a pair of raised end bosses. The raised end bosses are elongated in the longitudinal dimension and are formed within the final width dimension of the plate so as to avoid the need for trimming of excess material along the edges of the plate. The method generates less scrap than prior art processes using progressive stamping, and also permits variation of the plate lengths.

43 Claims, 6 Drawing Sheets

HEAT EXCHANGER PLATES AND MANUFACTURING METHOD

This application claims priority to Canadian Patent Application No. 2,420,273 filed Feb. 27, 2003.

FIELD OF THE INVENTION

The invention relates to methods for manufacturing plates for heat exchangers, particularly to methods in which generation of scrap is reduced, and to heat exchanger plates made by these methods.

BACKGROUND OF THE INVENTION

Heat exchangers are commonly made from multiple stacked plate pairs which define coolant flow passages extending between a pair of headers. As shown in FIG. 1 of U.S. Pat. No. 6,273,183 issued on Aug. 14, 2001 to So et al., the plates of each pair are arranged in back-to-back relation and are joined together at their peripheral edges. The plates have raised central portions which define a flow passage therebetween and in which turbulizers may be located. Raised bosses are provided at the ends of the plates, and are apertured to provide inlet and outlet openings. When the heat exchanger is assembled, the bosses are aligned and in communication with one another thereby forming a pair of headers. Expanded metal fins may then be located between the plate pairs to allow another fluid, such as air, to flow transversely through the plate pairs. The raised end bosses also serve to create spaces between the plate pairs for insertion of the fins.

The individual plates making up such a heat exchanger are usually formed by a process known as "progressive stamping" in which the plates are progressively formed by successive stamping operations performed on a coil of sheet metal. As explained above, the end bosses must be of a sufficient height to allow insertion of cooling fins. The bosses must also be of a specific diameter or area to allow sufficient coolant flow through the headers. Thus, the strip width required for each plate is generally determined by the width of strip material required for formation of the bosses.

In many cases, the width of strip material required to form the bosses is greater than a desired width of the plate pairs. This results in the need to trim excess material along the edges of the plates, particularly between the end portions in which the bosses are formed. The amount of scrap material generated by conventional progressive stamping of heat exchanger plates can be as high as 35 percent.

Thus, there is a need for improved methods of forming heat exchanger plates in which generation of scrap is reduced or eliminated, and in which plates of varying lengths may be produced without excessive tooling costs.

SUMMARY OF THE INVENTION

In one aspect, the present invention provides a method for forming a plate for a heat exchanger, the plate having a length and a width, the length defining a longitudinal axis, the method comprising: (a) providing a flat, sheet metal strip having elongate, longitudinally extending side edges, the strip having a width substantially the same as the width of the plate; (b) forming a fluid flow channel extending along the side edges of the strip, the fluid flow channel being raised relative to the side edges; and (c) forming a pair of raised bosses in the strip, the bosses being raised relative to the side edges and the fluid flow channels, wherein a longitudinal dimension of the bosses is greater than a transverse dimension of the bosses.

In another aspect, the present invention provides a heat exchanger plate, comprising: (a) a central portion defining an elongate fluid flow channel; (b) a pair of end portions separated by the central portion; (c) a raised boss provided in each of the end portions, each raised boss having an interior and an upper surface provided with a fluid flow aperture, wherein the interiors of the bosses are in communication with the fluid flow channel; (d) a planar flange extending continuously about an entire periphery of the plate and surrounding the fluid flow channel and the raised bosses; and (e) a plurality of tabs, each of which is integrally formed with the flange and extends from the flange, each of the tabs being located in one of the end portions of the plate.

In yet another aspect, the present invention provides A heat exchanger, comprising a plurality of plate pairs formed from the heat exchanger plates according to the invention, each of the plate pairs being formed by sealing the flanges of the plates together with the interiors of the bosses of one plate communicating with the interiors of the bosses of the other plate and so that the central portions of the plates combine to form a fluid passage in communication with the interiors of the bosses, the plate pairs being stacked with the apertures of the bosses in registry, the bosses of the plate pairs forming a pair of headers.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
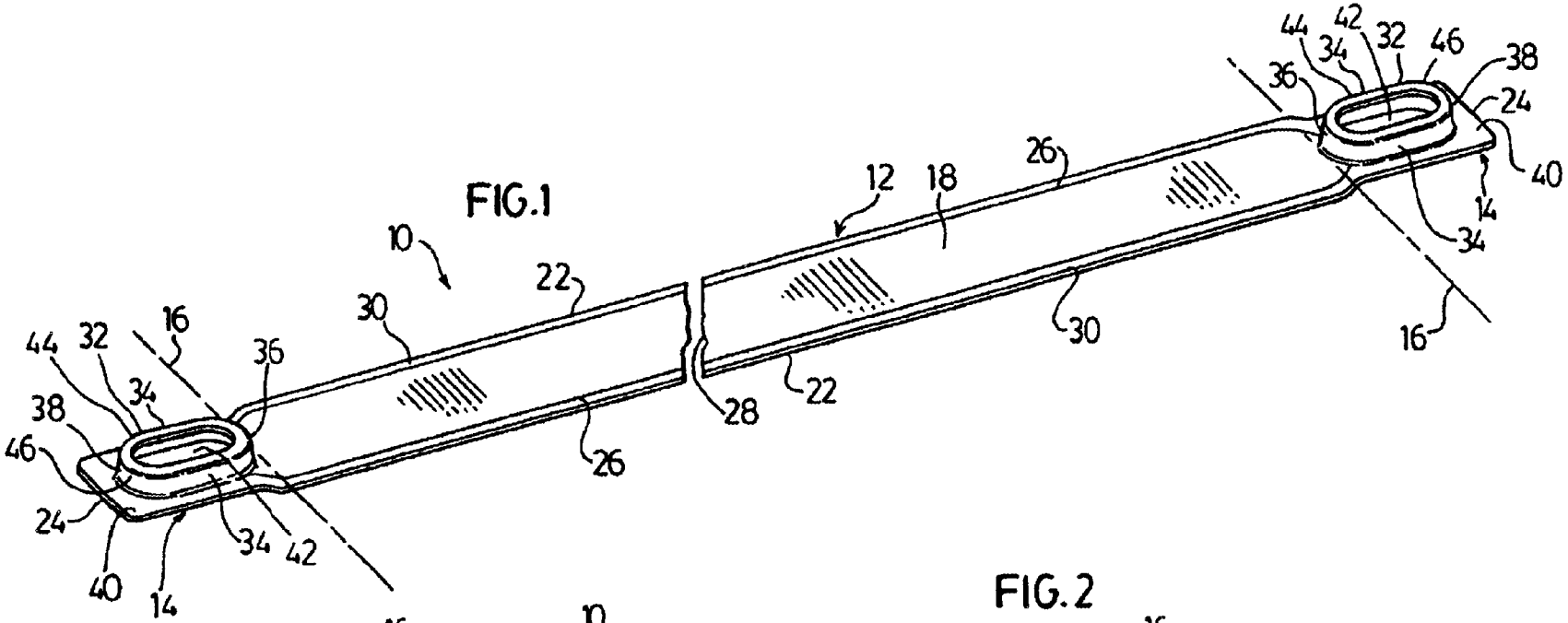
FIG. 1 is a top, perspective view of a preferred heat exchanger plate according to the present invention.
Figure 2:
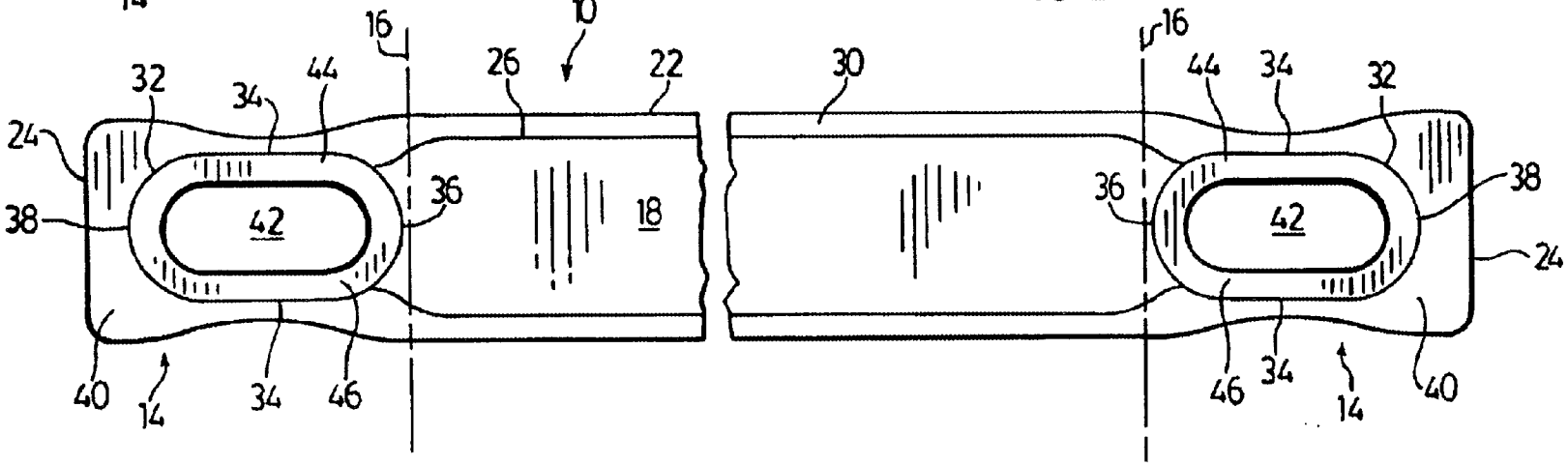
FIG. 2 is a top plan view of the plate shown in FIG. 1.
Figure 3:
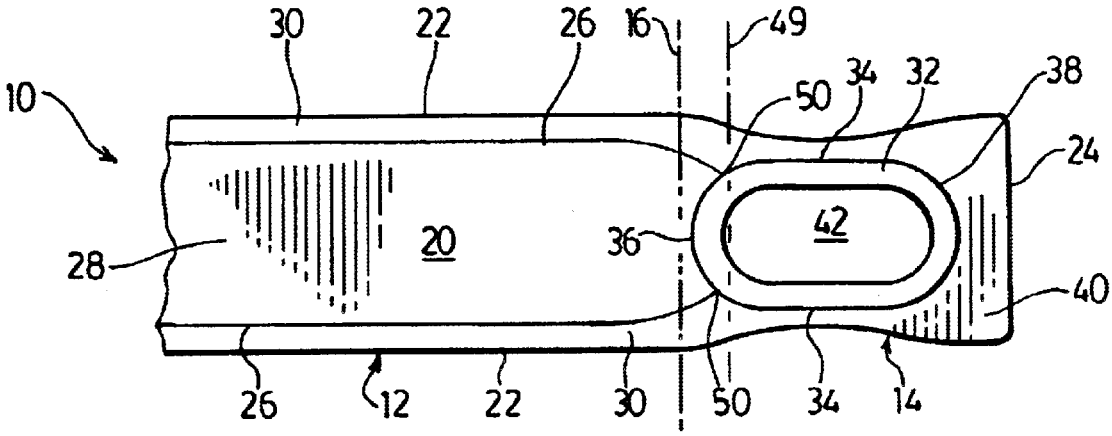
FIG. 3 is a bottom plan view of the plate shown in FIG. 1.

FIGS. 1 to 3 illustrate a preferred heat exchanger plate 10 according to the present invention. The plate 10 has an elongate central portion 12 located between a pair of end portions 14. Doffed lines 16 shown in FIGS. 1 to 3 indicate the approximate boundaries between the central portion 12 and the end portions 14.

The plate 10 has an upper surface 18 and an opposed lower surface 20, with elongate side edges 22 extending along the entire length of plate 10 and terminating at end edges 24. Extending along the side edges 22 of plate 10 are a pair of shoulders 26, these shoulders 26 defining a longitudinally extending fluid flow channel 28 extending along the lower surface 20 of plate 10. The fluid flow channel 28 preferably extends along substantially the entire central portion 12 of plate 10, and may preferably extend beyond dotted lines 16 into the end portions 14 of plate 10. The shoulders 26 are spaced from the side edges 22 so as to form flat peripheral side flanges 30 between the side edges 22 and the shoulders 26. The side flanges 30 extend longitudinally along the side edges 22 between the end portions 14.

Located in the end portions 14 of plate 10 are a pair of raised bosses 32. The bosses 32 are raised relative to the side edges 22 and relative to the fluid flow channel 28, having a height sufficient such that when a heat exchanger is formed by stacking plate pairs formed from plates 10, each plate pair formed by joining a pair of plates 10 with their lower surfaces facing one another, sufficient space exists between the plate pairs for insertion of cooling fins.

The bosses 32 can be of any desired shape, including circular. Preferably, the bosses 32 each have a major diameter extending in the longitudinal direction which is greater than a minor diameter extending in the transverse direction. Most preferably, the bosses are of an oval shape. As used herein, the term "oval" refers to any non-circular shape having a generally smoothly curving periphery, such as an ellipse, a rectangle with rounded corners, or other oblong or egg shape. In the preferred embodiment shown in the drawings, the bosses 32 are oval in plan view, having substantially straight longitudinally extending sides 34 extending between smoothly curved ends, a proximal end 36 located at or near the dotted line 16 between the central portion 12 and end portions 14, and a distal end 38 located proximate the end edge 24 of the plate 10.

As shown in FIG. 2, the sides 34 of bosses 32 are spaced inwardly from the side edges 22 and the distal ends 38 of bosses 32 are spaced inwardly from the end edges 24, thereby forming peripheral end flanges 40 extending around the end portions 14 of plate 10. The side flanges 30 and peripheral end flanges 40 combine to form a continuous flange about the entire periphery of the plate 10. The continuous flange provides a surface along which a pair of plates 10 can be joined, for example by brazing, in back-to-back relation (with lower surfaces 20 facing one another) to form a plate pair.

In order to provide fluid communication through the headers after assembly of the heat exchanger, the upper surface 44 of each boss 32 is provided with an aperture 42. The area of the aperture 42 is sufficiently large to provide adequate fluid flow throughout the header, while maintaining an annular sealing surface 46 on the upper surface 44. During assembly of the heat exchanger, adjacent plate pairs are joined to one another, for example by brazing, along the annular sealing flanges 46. As shown in the preferred plate 10, the aperture 42 may preferably be centred on upper surface 44 and may generally follow the shape of the raised bosses 32, although this is not essential.

As best seen in the bottom plan view of FIG. 3, the side flanges 30 become broader and curve inwardly toward one another as they approach the bosses 32, such that the side flanges 30 intersect the bosses 32 at points 50 which are located proximate the intersection between the sides 34 and the proximal ends 36 of the bosses 32. Thus, each peripheral end flange 40 substantially extends only around the sides 34 and distal end 38 of a boss 32, leaving an area 49 (substantially coextensive with proximal end 36) at which the fluid flow channel 28 is in flow communication with the interior of the boss 32.

As mentioned above, the plate pairs formed from plates 10 may be provided with turbulizers such as the expanded metal turbulizers disclosed in the above-mentioned patent to So et al., which is incorporated by reference herein in its entirety. The turbulizers are preferably rectangular in shape and are received between the plates 10 of the plate pairs, preferably extending throughout substantially the entire central portions 12 of the plates 10. As well as enhancing heat transfer, turbulizers provide support for the central portions 12 of plates 10, preventing collapse or narrowing of the fluid flow channels 28. In a heat exchanger constructed from pairs of plates 10, the ends of the turbulizers preferably overlap the proximal curved ends 36 of the bosses 32, so that the turbulizers provide support along the entire length of the fluid flow channels 28. The inward tapering of the side flanges 30 functions as an integral turbulizer stop so as to prevent longitudinal sliding of the turbulizer between the plate pairs. A preferred position of the end of a turbulizer (not shown) is indicated by dotted line 51 in FIG. 3.

Having now described the preferred heat exchanger plate 10 according to the invention, the following is a description of a preferred method for manufacturing a heat exchanger plate 10 according to the invention.

One preferred method of the invention begins by providing a sheet metal strip 52, preferably comprised of a brazeable material, which is preferably selected from the group comprising aluminum, an aluminum alloy, and aluminum or aluminum alloy coated with a brazing filler metal. The strip 52 as defined herein is of indefinite length, having longitudinally extending side edges 54, an upper surface and an opposed lower surface (not shown). The width of strip 52, measured in the transverse direction, is substantially the same as the width of the plate 10 described above.

A plurality of strips 52 may be formed by longitudinally slitting a coil of sheet metal (having a width greater than the width of strip 52) at one or more points across its width, with the longitudinal direction of the strip 52 being parallel to the direction of slitting. Alternatively, strips 52 may be formed by dividing a coil into sheets which are then slit longitudinally or transversely into strips 52.

During the method of the invention, the strip 52 is severed in the transverse direction at one or more points to form a plurality of blanks 53, each of which has a length, measured in the longitudinal direction, which is substantially the same as the length of plate 10.

Another preferred method of the invention begins by providing a sheet metal blank 53 having a width the same as that of strip 52 and having a length which is substantially the same as that of plate 10. The blanks 53 may preferably be formed as described above by transversely severing strips 52 of indefinite length. Where the length of the blank 10 is the same as the width of the sheet metal coil, the blanks 53 may be formed by cutting transversely across the width of the coil. Where the length of the blank 53 is somewhat greater than the width of the coil, the blanks 53 may be formed by slitting the coil diagonally, that is with the side edges 54 of the strip 52 being angled relative to the transverse direction of the coil.

Figure 4:
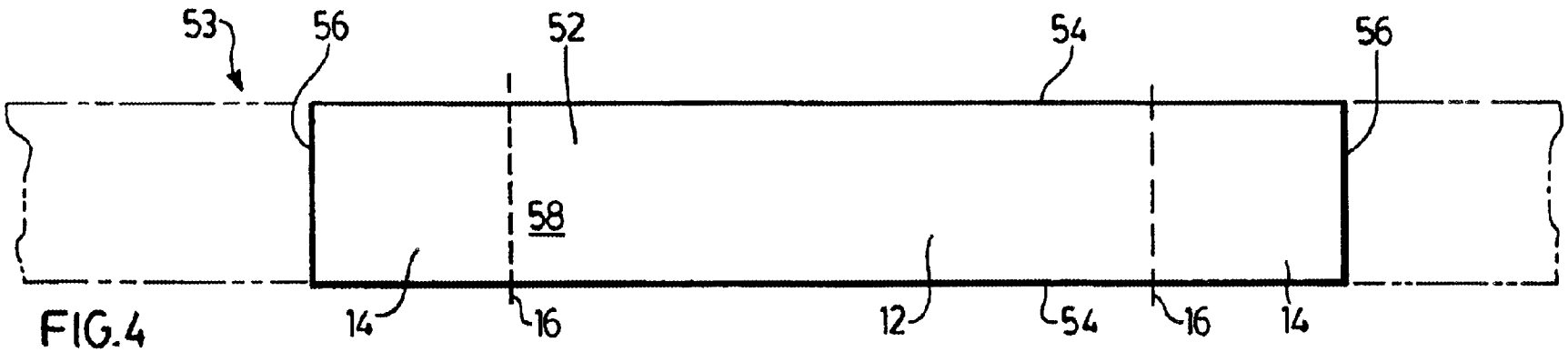
FIG. 4 is a top plan view of a strip or blank from which the plate of FIG. 1 is formed.
Figure 5:
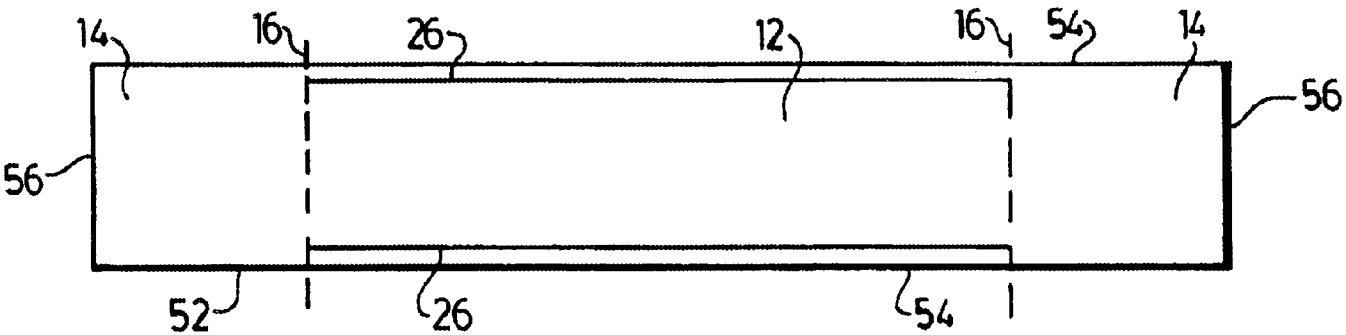
FIG. 5 is a top plan view of the blank of FIG. 4, after formation of the flow channel.
Figure 6:
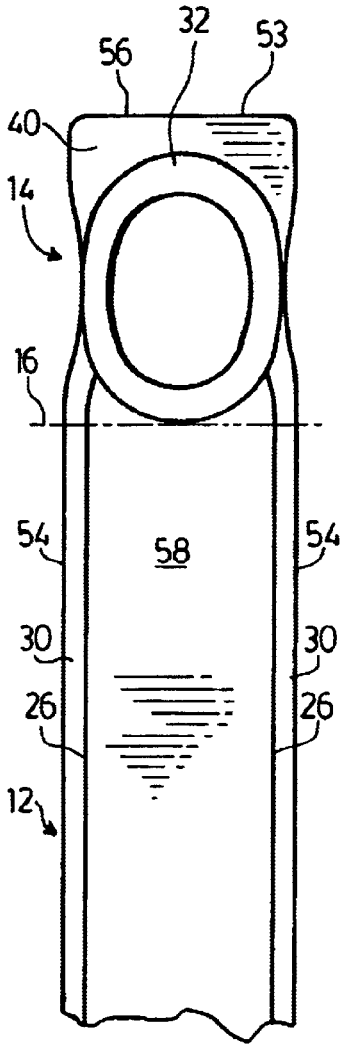
FIG. 6 is a top plan view of the blank of FIG. 5, after a first boss stamping step.
Figure 7:
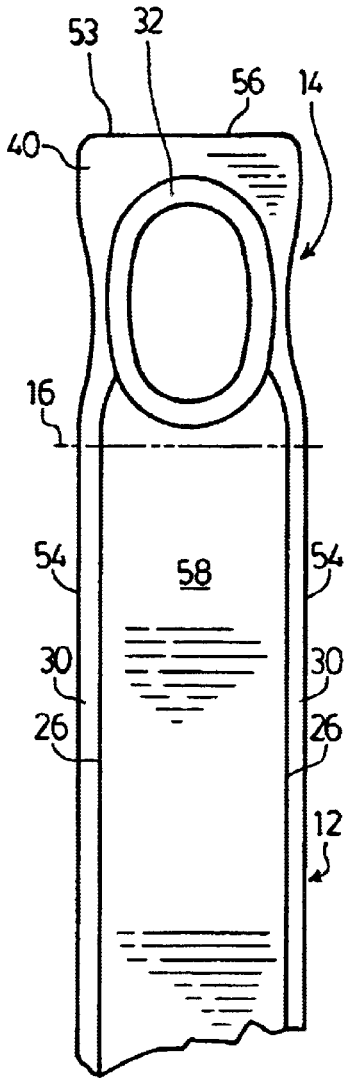
FIG. 7 is a top plan view of the blank of FIG. 6, after a second boss stamping step.
Figure 8:
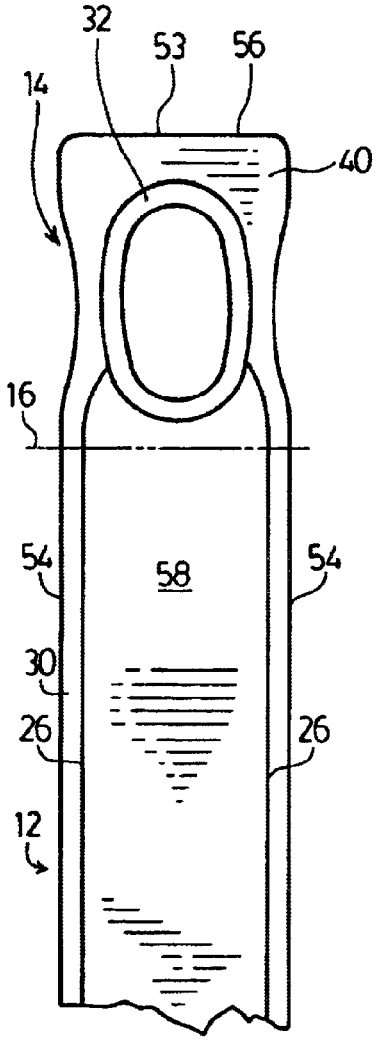
FIG. 8 is a top plan view of the blank of FIG. 7, after a third boss stamping step.

Except as otherwise indicated, the method now described below begins with a blank 53 having a length and a width which are substantially the same as the length and width of the plate 10. However, to indicate that the method may begin with the provision of either a strip 52 or a blank 53, FIG. 4 illustrates (in dotted lines) portions of strip 52 extending beyond the end edges 56 of blank 53. In addition, FIGS. 4 and 5 show the central portions 12, end portions 14 and the dotted lines 16 separating the central and end portions 12 and 14.

The next step in the method comprises the formation of the fluid flow channel 28, preferably by formation of shoulders 26 along the side edges 54 of the blank 53. Preferably, as shown in FIG. 5, the shoulders 26 terminate so as not to substantially extend into the end portions 14. In the preferred embodiment shown in FIG. 5, the shoulders 26 terminate at the line 16 dividing the central portion 12 from the end portions 14. The termination of shoulders 26 is preferred so that the shoulders do not interfere with formation of a flat end flange 40 in the end portion of plate 10.

It will be appreciated that the formation of shoulders 26 provide each plate 10 with a single, longitudinally extending flow channel 28, with side flanges 30 extending along either side of the flow channel 28. The plates 10 may, however, be of more complex configuration and may be formed with more than one flow channel, although all configurations would be formed with flanges adjacent the side edges 54, and a raised central portion forming the flow channel(s).

As mentioned above, the width of strip 52 or blank 53 is substantially the same as the width of plate 10. As used herein with reference to the width of plate 10, the term "substantially the same" is intended to mean that the width of strip 52 or blank 53, measured transversely across the central portion 12 thereof, after formation of flow channel 28, is the same as the width of the plate 10, measured transversely across the central portion 12 thereof, such that no edge trimming of the plate 10 is required. It will be appreciated that the width of the strip 52 or blank 53, prior to formation of the flow channel 28, will be slightly greater than the width of plate 10 since the material required for formation of the shoulders 26 will be drawn from the width of the strip 52 or blank 53.

It will be appreciated that, where the method begins by provision of a strip 52 of indefinite length, the shoulders 26 may be roll-formed prior to severing the strip 52 into individual blanks 53. Of course, the shoulders 26 may also be formed by stamping the strips 52 or blank 53 with an appropriate die.

The next step in the method comprises formation of the raised bosses 32 in each of the end portions 14 of strip 52 or blank 53. The bosses 32 are formed by a plurality of successive stamping operations, with the degree of boss formation in each successive stamping operation being illustrated in FIGS. 6 to 9. As can be seen from the drawings, some of the material from which the bosses 32 are formed is drawn from the surrounding material of the strip 52 or blanks 53. This results in material of the end portions 14 becoming drawn inwardly toward the bosses 32. This is apparent from FIGS. 6 to 9 which show the side edges 54 of the strip 52 or blank 53 converging inwardly toward one another along the sides 34 of the bosses 32.

In the most preferred embodiments according to the invention, it is preferred that the strips 52 are severed into blanks 53 prior to formation of bosses 32, and that the bosses 32 are formed by successive stamping operations by pairs of dies. The dies are preferably mounted in an apparatus in such a manner that the distance between the dies can be adjusted, thereby permitting the formation of plates having various lengths, which is not possible in progressive stamping dies.

It will be appreciated that the length, width and height of the bosses 32 are selected such that the heat exchanger formed by pairs of plates 10 will have a desired flow through its headers, such that a desired spacing will be maintained between the plate pairs to allow insertion of cooling fins, and such that the bosses 32 may be formed within the width dimension of the strip 52 or blank 53, thereby avoiding the need to trim excess material from the edges of the plate 10.

After formation of the bosses 32, the next step in the method comprises the formation of apertures 42 in bosses 32, for example using a cutting die.

Figure 9:
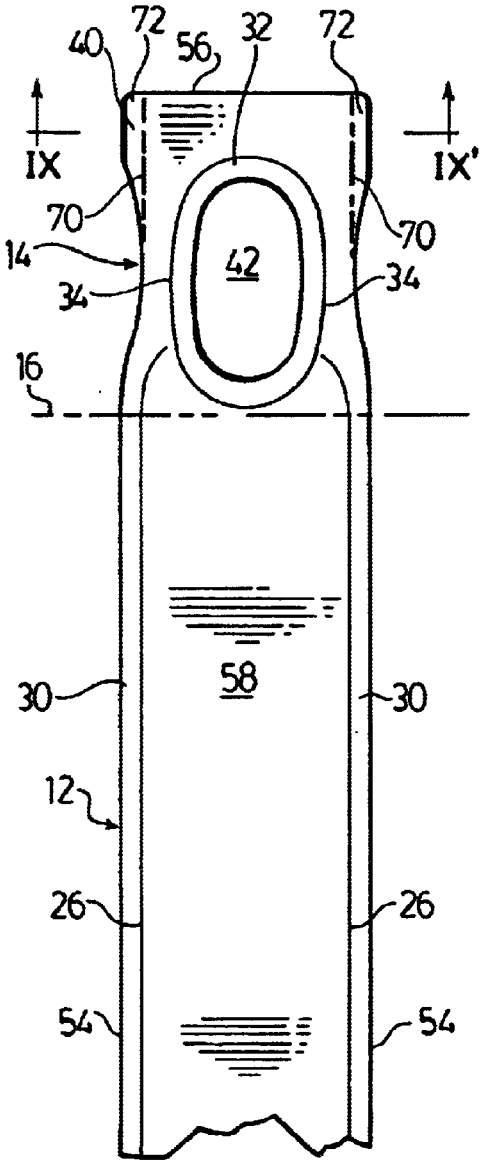
FIG. 9 is a top plan view of the blank of FIG. 8, after a fourth boss stamping step.

As shown in FIG. 9, there may be some excess material located between the distal end 38 of the bosses 32 and the end edges 24 of the plate 10.

Figure 10:
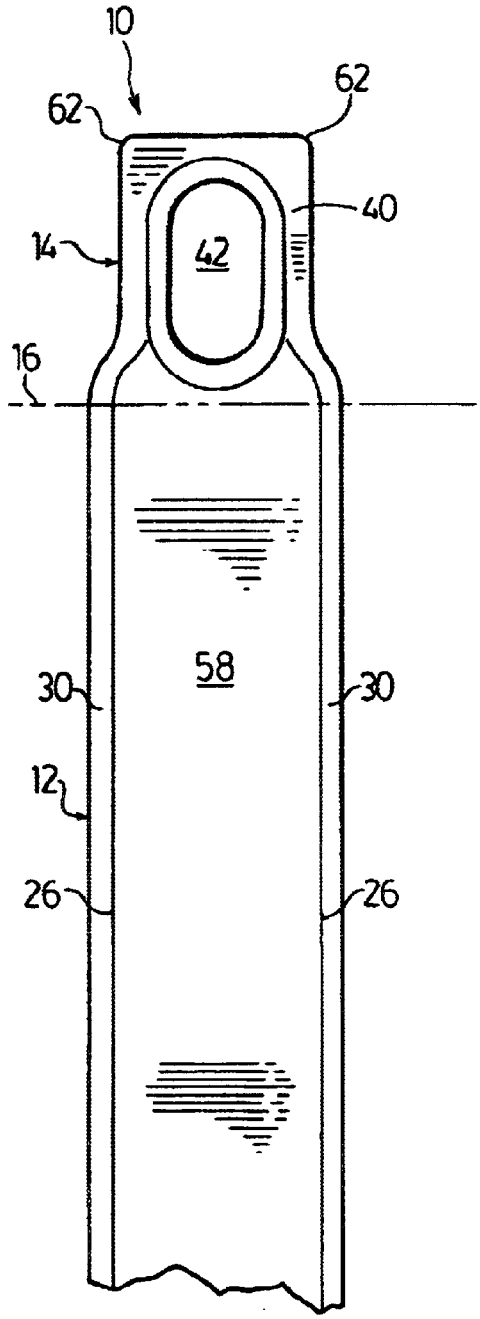
FIG. 10 is a top plan view of the blank of FIG. 9, after formation of the apertures in the bosses and optional trimming of the end flange.

Although not essential, some of this material may be removed by trimming, for example to provide smoothly rounded edges 62 as shown in FIG. 10, while maintaining an end flange 40 of sufficient dimensions to allow leak-free formation of the plate pairs, for example by brazing.

As mentioned above, the length of the blank 53 is substantially the same as the length of plate 10. As used herein with reference to the length of plate 10, the term "substantially the same" is intended to mean that the total length of blank 53, measured longitudinally between end edges 56, after formation of bosses 32, is the same as the total length of plate 10, before end trimming as described in relation to FIG. 10. It will be appreciated that the length of the blank 53, prior to formation of the bosses 32, will be slightly greater than the length of plate 10, before end trimming, since the formation of bosses 32 will somewhat reduce the length of the blank 53.

Figure 11:
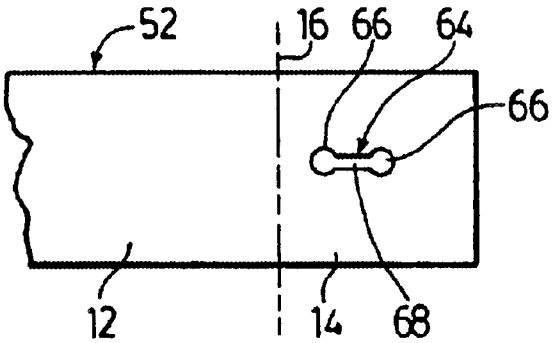
FIG. 11 illustrates an alternate blank according to the invention having apertured end portions.

As can be seen from FIGS. 6 to 9, the end flanges 40 of plate 10 reach their narrowest points adjacent the edges 34 of bosses 32, due to the fact that much of the material from which the bosses 32 are formed is drawn inwardly from the surrounding portions of the strip 52 or blank 53. Excessive narrowing of the flange 40 in these regions results in narrowing of the surfaces along which the plate pairs are formed, possibly affecting the reliability of joint formation in this area, and limiting the width dimensions of the bosses 32. To avoid excessive narrowing of flange 40 in this region, the strips 52 or blanks 53 may preferably be provided with apertures 64 in the end portions 14. These apertures 64 are centrally located in the areas of end portions 14 which will be cut out to form the flow apertures 42 of bosses 32. During formation of bosses 32, some of the material required for formation of the bosses 32 will be drawn outwardly from apertures 64 in the direction of the arrows in FIG. 11, thereby reducing the amount of material which is drawn from the area surrounding the bosses 32.

In the preferred embodiment of the invention, in which the bosses 32 and apertures 42 are oval in shape, the apertures 64 are preferably also elongated in the longitudinal direction. In the particularly preferred embodiment shown in FIG. 11, the apertures 64 may be dumbbell-shaped, comprising a pair of circular apertures 66 joined by a longitudinal slit 68.

Figure 12:
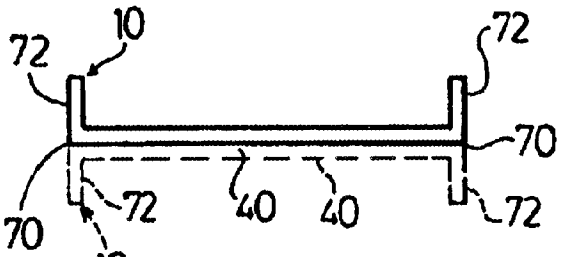
FIG. 12 is a cross section of an alternate preferred plate according to the invention, taken along line IX–IX' of FIG. 9.

Rather than trimming the end flange 40 as shown in FIG. 10, the flanges 40 may be bent along lines 70 shown in FIG. 9 to form tabs 72. The lines 70 are parallel to the longitudinal axis and are substantially tangential with the curve defined by the inwardly curved portion of flange 40, which is located proximate the sides 34 of bosses 32. As shown in FIG. 12, the tabs 72 preferably extend at right angles to the remainder of flange 40, and are preferably both bent upwardly. Thus, when the plates 10 are combined to form plate pairs, the ends of the plate pair have an H-shaped cross section, having tabs 72 extending both upwardly and downwardly from flanges 40. The configuration of the tabs 72 in a plate pair 74 is also illustrated in FIG. 12, with a second plate 10 being illustrated in dashed lines.

When the plate pairs 74 are stacked to form a heat exchanger, the tabs 72 will extend into the space between the plates 10. In some preferred embodiments, the tabs 72 of adjacent plate pairs 74 are of sufficient height to abut one another, and may become connected to one another during brazing of the heat exchanger, thus providing an additional brazed connection between the plates 10. In other preferred embodiments, the tabs are of lesser height, such that the tabs 72 of adjacent plate pairs do not contact one another. Where the tabs 72 of adjacent plate pairs do not engage one another, they serve to provide a plurality of surfaces to which a heat exchanger mounting bracket may be secured. Of course, a mounting bracket can also be secured to the tabs 72 in the embodiment where the tabs of adjacent plate pairs 74 abut one another.

Figure 13:
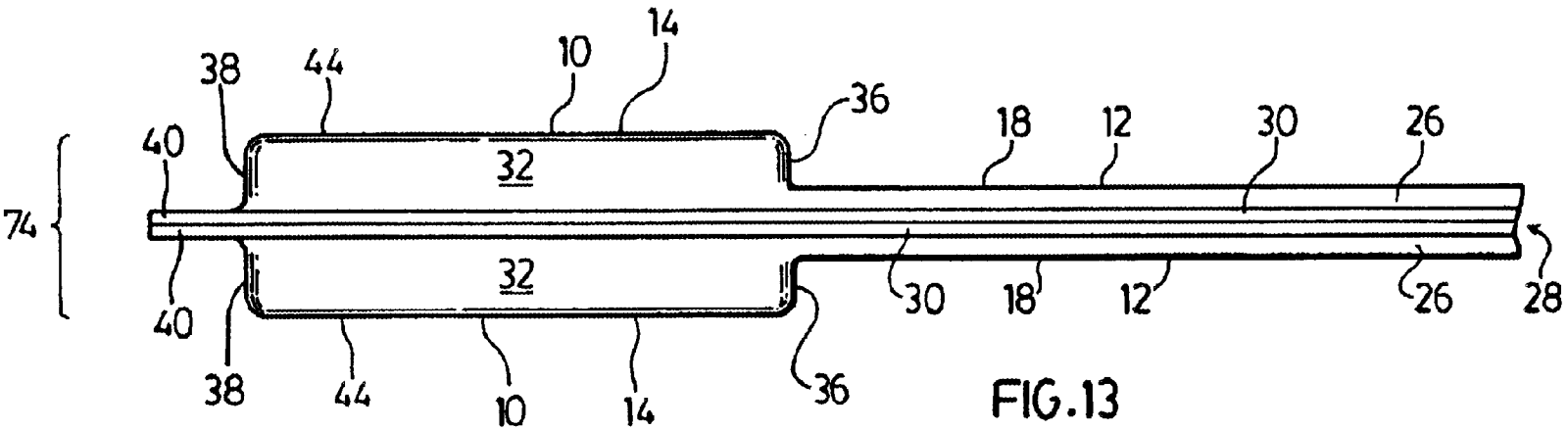
FIG. 13 is a side view of a plate pair formed from a pair of plates shown in FIG. 1.

FIG. 13 is a side view showing one end of a preferred plate pair 74 which is formed by joining a pair of plates 10 in back-to-back relation, such that the flanges 30 and 40 of the plates 10 engage one another and are joined in a leak-free manner, such as by brazing.

Although the method according to the invention has been described as including formation of the flow channel prior to formation of the bosses, it is to be appreciated that this sequence of steps is preferred, but not essential. In other preferred embodiments, the bosses may be formed prior to formation of the flow channel. However, it may be preferred to form the flow channel first since the channel form improves the rigidity of the blank, thereby reducing its tendency to bend or twist, and possibly resulting in improved accuracy of the boss stamping operation.

Although the invention has been described in relation to certain preferred embodiments, it is not limited thereto. Rather, the invention includes all embodiments which may fall the scope of the following claims.

What is claimed is:

1. A method for forming a plate for a heat exchanger, the plate having a length and a width, the length defining a longitudinal axis, the method comprising:

(a) providing a flat, sheet metal blank having elongate, longitudinally extending side edges, the blank having a width substantially the same as the width of the plate and having a length substantially the same as a length of the plate, the blank having a pair of opposed end portions;

(b) forming a fluid flow channel extending along the side edges of the blank, the fluid flow channel being raised relative to the side edges; and (c) forming a pair of raised bosses in the end portions of the blank, the bosses being raised relative to the side edges and the fluid flow channels, each of the bosses being formed inwardly of a peripheral edge of one of the end portions such that a peripheral sidewall of the boss is spaced from the peripheral edge of one of the end portions, thereby forming a peripheral flange along the peripheral edge of the end portion;

wherein each of the peripheral flanges is bent along a line which is parallel to the longitudinal axis thereby forming a tab which extends substantially at right angles to a remaining portion of the peripheral flange, the tabs having a height sufficient to engage one of the tabs or the peripheral flange of an adjacent plate during formation of the heat exchanger.

2. The method of claim 1, wherein a longitudinal dimension of the bosses is greater than a transverse dimension of the bosses.

3. The method of claim 1, wherein the fluid flow channel is formed by forming a pair of shoulders in the blank, each of the shoulders extending longitudinally along one of the side edges, such that the fluid flow channel comprises a raised portion of the blank extending longitudinally along the blank and extending transversely between the shoulders.

4. The method of claim 3, wherein each of the shoulders is spaced from one of the side edges so as to form a flat peripheral flange between the side edge and the shoulder and extending longitudinally along the side edges.

5. The method of claim 4, wherein the shoulders terminate so as not to substantially extend into the end portions.

6. The method of claim 1, wherein a width of the blank after formation of the fluid flow channel is the same as the width of the channel plate.

7. The method of claim 1, wherein the fluid flow channel is formed by stamping.

8. The method of claim 1, wherein the fluid flow channel is formed by rolling.

9. The method of claim 1, wherein the bosses are formed by one or more stamping or drawing operations.

10. The method of claim 1, further comprising the step of:

(d) forming a first aperture in an upper surface of each of the bosses.

11. The method of claim 10, wherein the first aperture in the upper surface of each of the bosses is formed by cutting out a central portion of the upper surface, the central portion having a second aperture.

12. The method of claim 11, wherein both the first and second apertures are elongated along the longitudinal dimensions of the bosses.

13. The method of claim 12, wherein the second aperture comprises a pair of spaced, circular holes joined by a longitudinally extending slit.

14. The method of claim 1, wherein the sheet metal blank is formed from a brazeable material.

15. The method of claim 14, wherein the brazeable material is selected from the group comprising aluminum, an aluminum alloy, and aluminum or an aluminum alloy coated with a brazing filler metal.

16. The method of claim 1, wherein both tabs are bent in the same direction.

17. The method of claim 1, wherein the tabs are bent in opposite directions.

18. A heat exchanger plate, comprising:

(a) a central portion defining an elongate fluid flow channel, the central portion having a pair of longitudinally extending side edges;

(b) a pair of end portions separated by the central portion;

(c) a raised boss provided in each of the end portions, each raised boss having an interior and an upper surface provided with a fluid flow aperture, wherein the interiors of the bosses are in communication with the fluid flow channel;

(d) a planar flange extending continuously about an entire periphery of the plate and surrounding the fluid flow channel and the raised bosses; and (e) a plurality of tabs, each of which is integrally formed with the flange and extends at an angle from the flange, each of the tabs being located in one of the end portions of the plate;

wherein each of the tabs extends from the flange along a line which is substantially parallel to the side edges of the central portion.

19. The heat exchanger plate of claim 18, wherein the lines along which the tabs extend are bend lines.

20. The heat exchanger plate of claim 18, wherein the lines along which the tabs extend are spaced from the bosses, with the flange extending between the bosses and the tabs.

21. The heat exchanger plate of claim 18, wherein each of the lines extends longitudinally from an end of the plate to a point proximate a side of one of the bosses.

22. The heat exchanger plate of claim 18, wherein the plate is provided with at least one of said tabs.

23. The heat exchange plate of claim 22, wherein at least one said tab is provided in each end portion of the plate.

24. The heat exchanger plate of claim 23, wherein the plate has a pair of said tabs is provided in each of the end portions, the tabs of each pair being located along opposite sides of one of the bosses.

25. The heat exchanger plate of claim 24, wherein the tabs of each pair are bent upwardly.

26. The heat exchanger plate of claim 18, wherein each of the tabs has a height not greater than a height of the bosses.

27. The heat exchanger plate of claim 18, wherein each of the tabs extends approximately perpendicular to the flange.

28. A heat exchanger, comprising a plurality of plate pairs formed from the heat exchanger plates of claim 18, each of the plate pairs being formed by sealing the flanges of the plates together with the interiors of the bosses of one plate communicating with the interiors of the bosses of the other plate and so that the central portions of the plates combine to form a fluid passage in communication with the interiors of the bosses, the plate pairs being stacked with the apertures of the bosses in registry, the bosses of the plate pairs forming a pair of headers.

29. The heat exchanger of claim 28, wherein the tabs of each plate have a height such that they abut, and are connected to, the tabs of a plate of an adjacent plate pair.

30. The heat exchanger of claim 28, wherein the tabs of each plate provide a plurality of surfaces for securing one or more heat exchanger mounting brackets.

31. The heat exchanger of claim 28, wherein each plate has a pair of tabs at each end, each of the tabs being bent upwardly such that a transverse cross section through the plate pair in a region where said tabs are formed is substantially H-shaped.

32. A method for forming a plate for a heat exchanger, comprising:

(a) providing a flat sheet metal blank having a pair of elongate, longitudinally extending side edges and having end edges extending between the side edges, the side edges being parallel to each other such that the blank is of constant width, the blank having a central portion located between a pair of longitudinally-spaced end portions;

(b) forming a pair of raised shoulders in the central portion of the blank, the shoulders being spaced from one another and spaced from the side edges, wherein a raised fluid flow channel is defined between the shoulders and wherein a width of the central portion after formation of the shoulders defines a maximum width of the plate; and (c) forming a pair of raised bosses in the blank, each of the bosses being formed in one of the end portions of the blank, each of the bosses having a pair of longitudinally-extending sides, having a longitudinal dimension which is greater than its transverse dimension, and being raised relative to the side edges and the fluid flow channels;

wherein, during formation of the bosses, material from the end portions of the blank is drawn inwardly toward the bosses, thereby causing the side edges to converge inwardly toward one another along the sides of the bosses, such that a transverse distance between the side edges reaches a minimum along the sides of the bosses;

wherein said minimum transverse distance between the side edges defines a minimum width of the plate; and wherein the shoulders and the bosses are sufficiently spaced from the side edges of the plate such that a continuous flange is formed along an entire periphery of the plate.

33. The method of claim 32, wherein said blank has a pair of said end edges, the end edges extending transversely between the side edges.

34. The method of claim 32, wherein the bosses are oval shaped and wherein the longitudinally-extending sides of the bosses are substantially straight.

35. The method of claim 32, further comprising the step of forming an aperture in an upper surface of each of the bosses.

36. The method of claim 32, wherein the plate is formed in the absence of edge trimming along the shoulders of the plate.

37. The method of claim 32, further comprising the step of severing the blank from a strip or sheet of sheet metal.

38. The method of claim 37, wherein the blanks are formed by severing the strip transversely at one or more points.

39. The method of claim 38, wherein the strip is severed prior to formation of the shoulders.

40. The method of claim 38, wherein the strip is severed after formation of the shoulders and prior to formation of the bosses.

41. The method of claim 32, wherein the shoulders terminate so as not to substantially extend into the end portions.

42. The method of claim 32, further comprising the step of trimming the plate along longitudinally extending lines, each of the lines extending tangentially along one of the side edges at a point where the side edge converges inwardly toward one of the bosses, each of the lines terminating at one of the end edges.

43. The method of claim 42, wherein said step of trimming the plate produces a rounded transition between the side edges and the end edges of the plate.

* * * * *

UNITED STATES PATENT AND TRADEMARK OFFICE

CERTIFICATE OF CORRECTION

PATENT NO. : 6,837,305 B2 
DATED : January 4, 2005
INVENTOR(S) : Peter Zurawel, Brian Ernest Duke and Raymond R. Caron It is certified that error appears in the above-identified patent and that said Letters Patent is hereby corrected as shown below:

Column 7,
Line 62, “axis” should read -- axis, --.

Column 9,
Line 12, “exchange” should read -- exchanger --.

Signed and Sealed this

Tenth Day of January, 2006

JON W. DUDAS
*Director of the United States Patent and Trademark Office*